US006528774B2

(12) United States Patent
Lee

(10) Patent No.: US 6,528,774 B2
(45) Date of Patent: Mar. 4, 2003

(54) BUILT-IN MICROWAVE OVEN

(75) Inventor: Sung-Geon Lee, Kyeongnam (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/168,614

(22) PCT Filed: Dec. 18, 2000

(86) PCT No.: PCT/KR00/01482

§ 371 (c)(1),
(2), (4) Date: Jun. 24, 2002

(87) PCT Pub. No.: WO01/49078

PCT Pub. Date: Jul. 5, 2001

(65) Prior Publication Data

US 2002/0190063 A1 Dec. 19, 2002

(30) Foreign Application Priority Data

Dec. 27, 1999 (KR) ..... 99-63095

(51) Int. Cl.[7] ..... H05B 6/80

(52) U.S. Cl. ..... 219/757; 219/702; 219/756; 126/21 A

(58) Field of Search ..... 219/757, 756, 219/681, 702; 126/21 A, 299 R, 299 D

(56) References Cited

U.S. PATENT DOCUMENTS

| | | | | |
|---|---|---|---|---|
| 4,332,993 A | | 6/1982 | Shibahara et al. | 219/10.55 R |
| 4,598,689 A | | 7/1986 | Eke | 126/21 A |
| 5,393,961 A | | 2/1995 | Umekage et al. | 219/757 |
| 5,847,377 A | | 12/1998 | Yang et al. | 219/757 |
| 6,005,235 A | * | 12/1999 | Shin | 219/757 |
| 6,218,654 B1 | * | 4/2001 | Braunisch | 219/757 |
| 6,344,637 B2 | * | 2/2002 | Lee et al. | 219/757 |

FOREIGN PATENT DOCUMENTS

| | | |
|---|---|---|
| EP | 0150488 A2 | 12/1984 |
| EP | 0224775 A1 | 11/1986 |
| EP | 0468640 A1 | 7/1990 |
| EP | 0743807 A2 | 11/1996 |
| GB | 2334871 A | 9/1999 |

* cited by examiner

*Primary Examiner*—Philip H. Leung
(74) *Attorney, Agent, or Firm*—Fleshner & Kim, LLP

(57) ABSTRACT

The object of this invention is to provide a built-in microwave oven, installed in kitchen furniture as an integral part of the furniture. In the microwave oven of this invention, a suction grille (10) and an exhaust grille (20) are provided on the front wall of the external casing, with a side air passage connecting the suction grille (10) to the exhaust grille (20). An exhaust fan (22) is provided in the side air passage at a front portion around the suction grille, while a partition wall (60) is longitudinally installed at a position in back of the exhaust fan (22). A PCB thereon, is installed within the rear passage defined in back of the partition wall (60). In an operation of the microwave e oven, the air discharged from the side air passage by the suction force of the exhaust fan (22) partially flows around the PCB support bracket (70) to cool the PCB prior to flowing through the side air passage to reach the exhaust grille (20).

10 Claims, 3 Drawing Sheets

BUILT-IN MICROWAVE OVEN

TECHNICAL FIELD

The present invention relates to microwave ovens and, more particularly, to a built-in microwave oven, designed to be installed in kitchen furniture at a predetermined position as an integral part of the kitchen furniture and having a cooling structure for forming cooling air currents capable of effectively cooling a variety of heat generating elements within the external casing of the oven.

BACKGROUND ART

As well known to those skilled in the art, a microwave oven is an electrically operated oven using high-frequency electromagnetic waves that penetrate food, causing its molecules to vibrate and generating heat within the food to cook it in a short time. Conventional microwave ovens are classified into two types: a tabletop microwave oven designed to be seated on a table and a ventilation hood-combined microwave oven integrated with a gas range at the top portion of the gas range and collaterally acting as a ventilation hood.

In recent years, some kinds of electric kitchen appliances, such as gas oven ranges and pickled vegetable refrigerators, have been designed as built-in types in an effort to accomplish the recent trend of compactness of kitchen systems. Such built-in kitchen appliances preferably accomplish a desired harmony and a desired integration of the electric kitchen appliances with kitchen furniture.

In addition, conventional microwave ovens are typically designed to radiate high-frequency electromagnetic waves from a magnetron into the cooking cavity to allow the electromagnetic waves to penetrate food within the cavity, thus causing molecules of the food to vibrate and generating heat within the food to cook it in a short time. However, such a conventional microwave oven is problematic in that it undesirably has only a single heating mode with high-frequency electromagnetic waves, and so another type of microwave oven having a heater in addition to such a magnetron has been recently proposed and used. That is, microwave ovens, designed to use heat of a heater in addition to high-frequency electromagnetic waves of a magnetron so as to accomplish the requirement for a variety of heating modes and a variety of heating conditions, have been proposed.

The representative example of conventional heaters used in such microwave ovens having heaters in addition to magnetrons is a quartz tube heater. In the microwave oven having such a quartz tube heater as an additional heat source, heat from the quartz tube heater is forcibly convected within the cooking cavity to accomplish a convection-heating effect and to heat food within the cavity to a higher temperature.

Still another type of microwave oven provided with a halogen lamp capable of generating higher temperature heat and browning the surface of food has been proposed and used. In such a microwave oven, halogen lamps are installed at the top and bottom wall of the cavity of the oven, and radiate heat energy and light energy into the cavity, thus heating food within the cavity more quickly. When such halogen lamps are installed in microwave ovens, the lamps generate very high temperature heat, and so it is necessary to additionally install a cooling device for effectively cooling the halogen lamps and the surroundings of the lamps.

In accordance with the recent trend of built-in type structure of kitchen appliances, consumers require built-in microwave ovens. In such built-in microwave ovens, it is desired to install additional heaters, such as halogen lamps, in the ovens so as to accomplish a variety of heating modes and a variety of heating conditions of said ovens.

Such built-in microwave ovens are also set in kitchen furniture as integral parts of the furniture, with only the front walls of the ovens exposed from the front surface of the furniture to allow users to reach said front walls. Therefore, it is necessary to design such built-in microwave ovens to allow air to pass through only the front walls of the ovens.

During an operation of such a built-in microwave oven, the magnetron and the high voltage transformer installed within the machine chamber, in addition to the heater, generates high temperature heat. It is thus necessary to cool the heater and the other heat generating elements installed within the machine chamber of a built-in microwave oven using cooling air current during an operation of the oven.

In such a built-in microwave oven, the air passage for the cooling air has to be provided at the front wall of the oven. However, such an air passage structure for built-in microwave ovens is completely different from that of the other types of conventional microwave ovens, and so it is impossible to use the conventional air passage structures in the built-in microwave ovens.

DISCLOSURE OF THE INVENTION

Accordingly, the present invention has been made keeping in mind the above problems occurring in the prior art, and an object of the present invention is to provide a built-in microwave oven, which is designed to be installed in kitchen furniture at a predetermined position as an integral part of the kitchen furniture and has a cooling structure for effectively cooling a variety of heat generating elements within the external casing the oven.

In order to accomplish the above object, the present invention provides a built-in microwave oven, comprising: a built-in microwave oven, comprising an external casing, and a cooking cavity set within the external casing and used for heating food seated therein; further comprising: a suction grille provided on the front wall of the external casing at a position corresponding to the upper portion above the cooking cavity for sucking air into the external casing; an exhaust grille provided on the front wall of the external casing for discharging air from the external casing to the atmosphere; a side air passage defined inside the sidewall of the external casing and used for guiding the air from the suction grille to the exhaust grille; a machine chamber air guide passage used for guiding the air from the suction grille to a machine chamber provided within the external casing at a position opposite to the side air passage; an exhaust fan provided within the external casing at a position in back of the suction grille and used for generating a part of the suction force for sucking air into the external casing through the suction grille, and a partition wall installed within the external casing at a position in back of the exhaust fan so as to partition the channel, defined in back of the exhaust fan, into separate air passages, whereby the air sucked into the external casing by the suction force of the exhaust fan partially flows through a rear passage defined in back of the partition wall to a front passage defined in front of the partition wall prior to flowing to the exhaust grille through the side air passage.

In such a microwave oven of this invention, it is possible to allow a sufficient amount of cooling air to smoothly flow through the passages defined by the partition wall, thus effectively cooling a PCB installed within said passages. In addition, it is also possible to form a sufficient amount of cooling air flowing within the external casing of the oven, thus effectively cooling a variety of heat generating elements of the oven during an operation of the oven.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
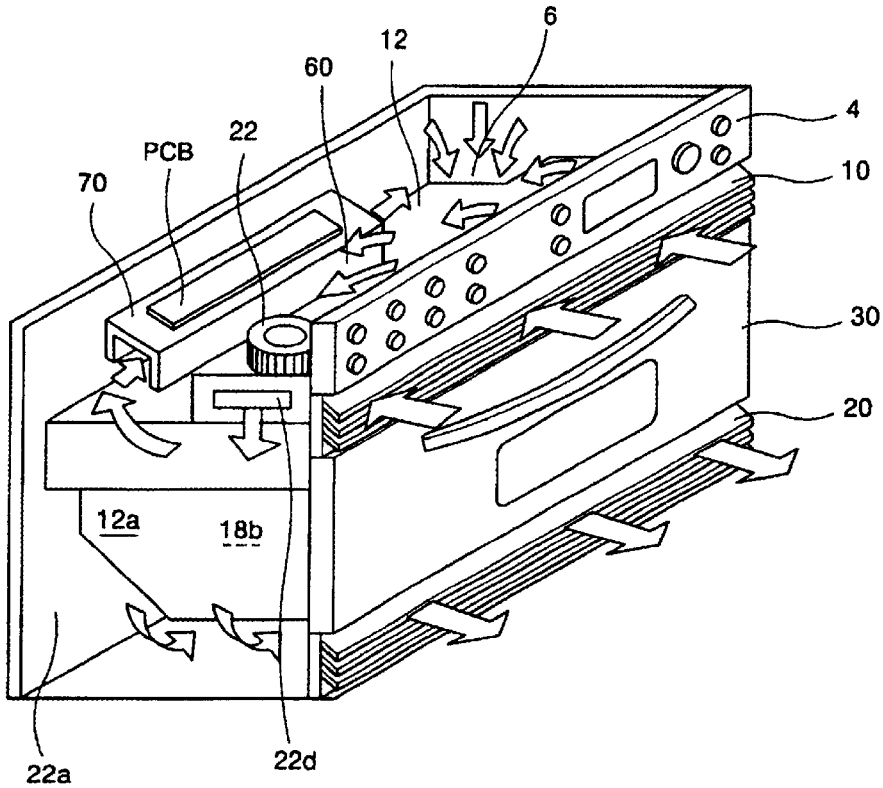
FIG. 1 is a top perspective view of a built-in microwave oven in accordance with the primary embodiment of the present invention.

Reference now should be made to the drawings, in which the same reference numerals are used throughout the different drawings to designate the same or similar components.

Figure 2:
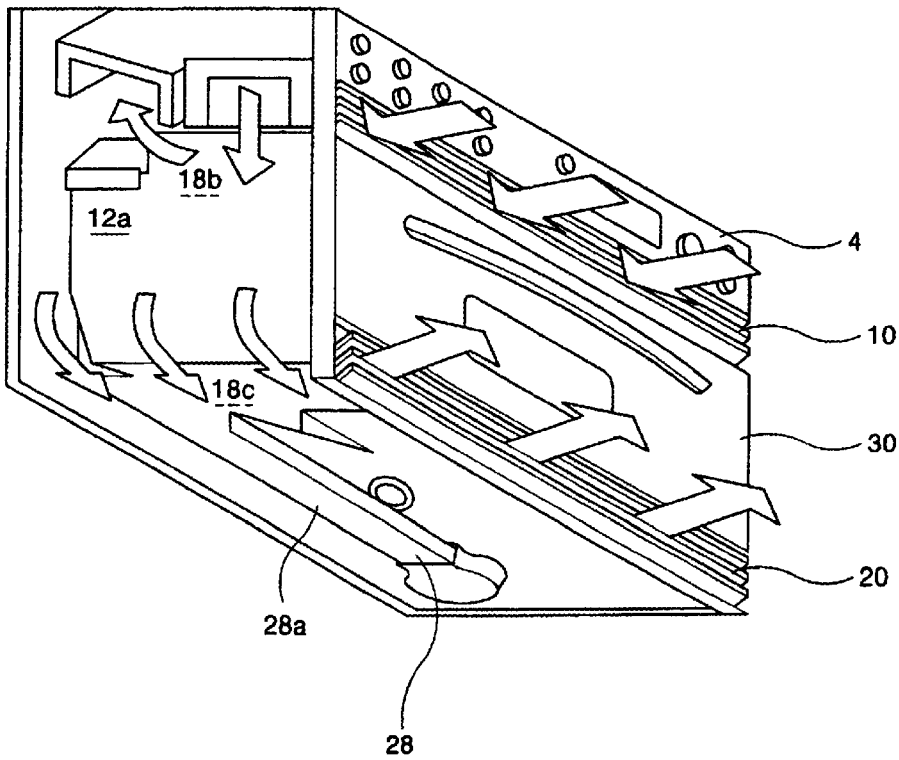
FIG. 2 is a bottom perspective view of the built-in microwave oven of FIG. 1.

FIGS. 1 and 2 are a top perspective view and a bottom perspective view of a built-in microwave oven in accordance with the primary embodiment of the present invention, As shown in the drawings, the front wall of the external casing of the built-in microwave oven is provided with a suction grille 10 and an exhaust grille 20. The suction grille 10 is provided at the upper portion of the front wall for sucking atmospheric air into the external casing of the oven to cool the heat generating elements of the oven during an operation of the oven. The exhaust grille 20 is provided at the lower portion of the front wall for discharging air from the external casing of the oven to the atmosphere after the air circulates in the oven while cooling a variety of heat generating elements.

Since the suction grille 10 and the exhaust grille 20 are positioned at the front wall of the external casing at positions above and under the front door 30, the inflow air sucked through the suction grille 10 is introduced into the upper portion of the cavity, while the outflow air discharged through the exhaust grille 20 flows through the lower portion of the cooking cavity prior to being discharged from the cavity.

The internal construction of the oven and the air circulation within the external casing of the oven will be described herein below with reference to FIGS. 1 to 4. As shown in the drawings, the suction force used for sucking atmospheric air into the external casing through the suction grille 10 is partially generated by an exhaust motor 22 provided on an upper partition panel 12.

Figure 4:
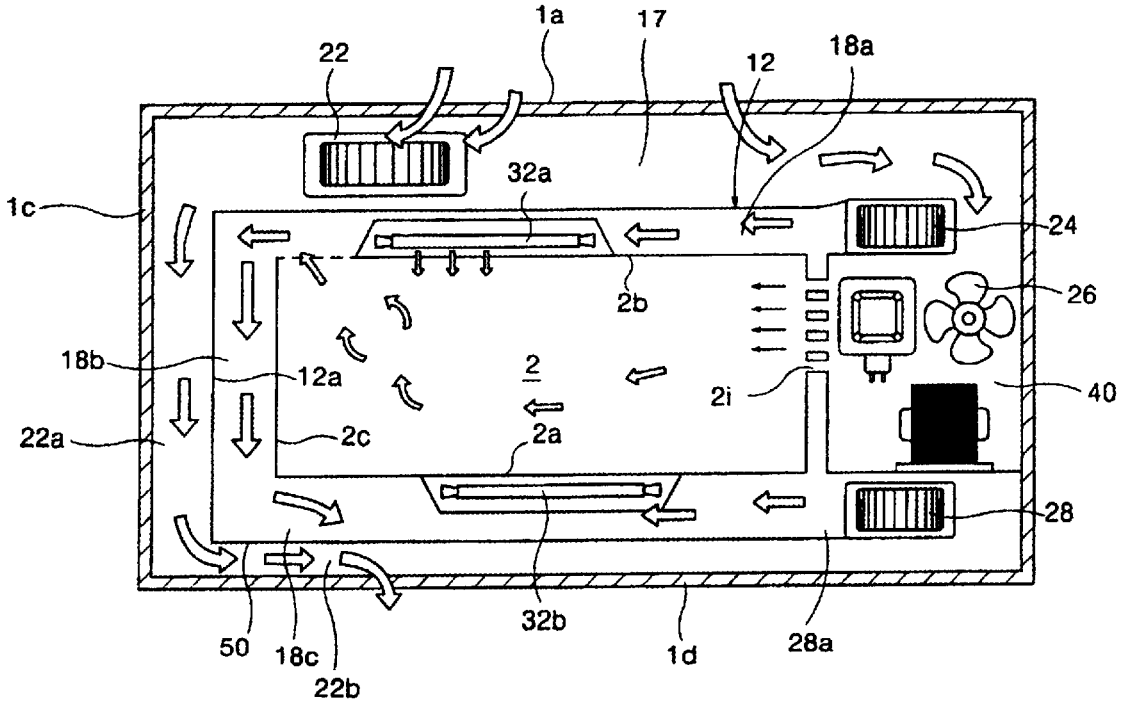
FIG. 4 is a sectional view of the built-in microwave oven of FIG. 1, particularly showing the internal construction of the microwave oven.
Figure 5:
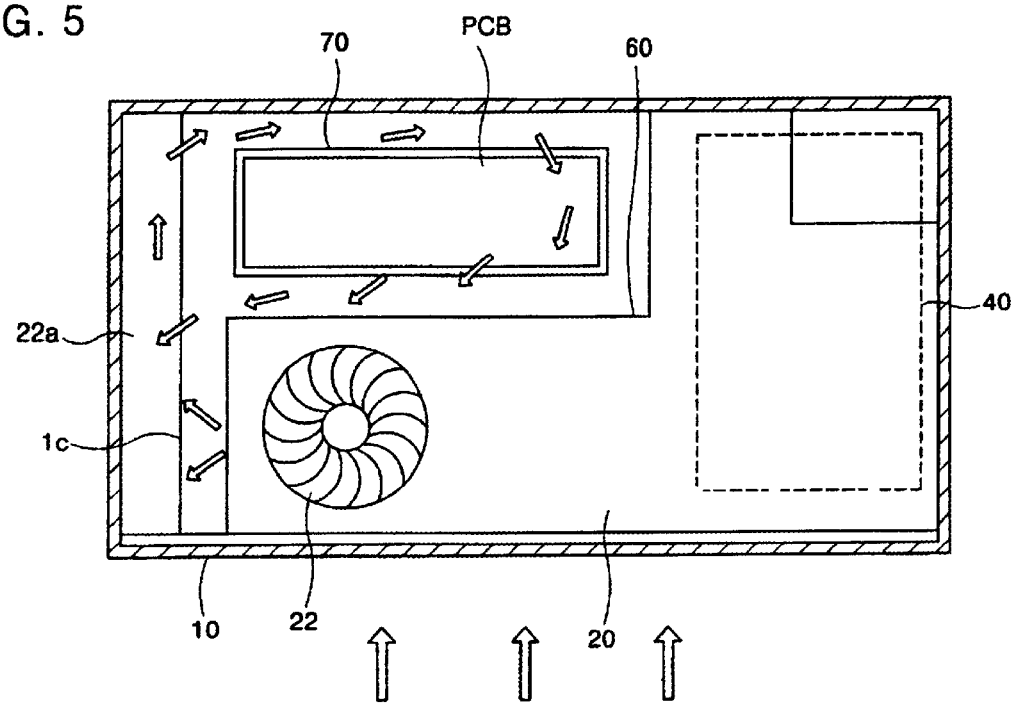
FIG. 5 is a plan view of the built-in microwave oven of FIG. 1, particularly showing the construction of the top portion of the microwave oven.

As best seen in FIG. 4, the exhaust motor 22 is installed on the upper partition panel 12 at a left-hand side position of the drawing, that is, at a position opposite to a machine chamber 40. The exhaust motor 22 generates suction force for sucking atmospheric air into the external casing of the oven through the suction grille 10. A partition wall 60 is longitudinally installed on the panel 12 at a position in back of the exhaust fan 22. That is, the exhaust fan 22 and the partition wall 60 are installed on the upper partition panel 12 at the front and rear positions.

The above partition wall 60 divides the upper channel within the external casing of the oven into front and rear passages, and guides the pressurized air current formed by the exhaust fan 22 while dividing the air current into two currents passing through the front and rear passages. A PCB support bracket 70 is installed on the upper partition panel 12 within the rear passage formed by the partition wall 60, with a printed circuit board (PCB) seated on the support bracket 70.

The above PCB support bracket 70 is regularly spaced apart from the upper surface of the upper partition panel 12 at a predetermined gap, thus dividing the air passage above the upper partition panel 12 into upper and lower passages allowing air currents to separately pass. Therefore, the PCB is effectively cooled by the air current flowing in the passage defined above the support bracket 70.

The above PCB is printed with a circuit, and seats a variety of electric devices thereon, and may be easily damaged or incapacitated by heat. It is thus necessary to sufficiently cool the PCB using the air current flowing in the passage defined above the support bracket 70 so as to maintain the desired function of the PCB and to accomplish the operational reliability of the microwave oven. In the microwave oven of this invention, an upper heater 32*a* is installed on the lower surface of the upper partition panel 12, and so the heater 32*a* may cause thermal damage to the PCB. Therefore, the PCB has to be cooled using the air current flowing in the passage defined above the support bracket 70.

The above exhaust motor 22 sucks air from the atmosphere into the external casing through the suction grille 10, and discharges the sucked air to a passage defined inside the sidewall of the external casing. As shown in FIGS. 1 and 2, the pressurized air current formed by the exhaust motor 22 is discharged through an air outlet opening 22*d* formed at the front portion of the partition wall 60 prior to flowing backward and downward.

That is, the inflow air from the suction grille 10 primarily passes through the exhaust motor 22, and is secondarily discharged from the motor 22 through the air outlet opening 22*d*. A part of the air discharged from the air outlet opening 22*d* flows down through a first side air passage 22*a* defined inside the sidewall 1*c* of the external casing (see FIG. 4), and finally flows through a lower inside air passage 18*c* between the bottom wall 2*a* of the cooking cavity 2 and the bottom wall 1*d* of the external casing prior to being discharged from the external casing of the oven to the atmosphere through the exhaust grille 20.

The remaining part of the air discharged from the air outlet opening 22*d* of the exhaust motor 22 is guided backward to pass by the PCB support bracket 70 while cooling the PCB on the bracket 70, and secondarily flows down through the first side air passage 22*a* as shown by the arrows in the drawings. The air from the first side air passage 22*a* finally flows through the lower inside air passage 18*c* prior to being discharged from the external casing of the oven to the atmosphere through the exhaust grille 20 in the same manner as that described above.

When the air flows from the air outlet opening 22*d* of the exhaust motor 22 to the PCB support bracket 70 as described above, the partition wall 60 prevents the air currents, flowing along the upper and lower passages formed by the bracket 70, from being undesirably mixed with the air current flowing through the front air passage having the exhaust fan 22. Therefore, the air current, flowing through the PCB support bracket 70 isolated from the exhaust fan 22 by the partition wall 60, passes around the rear portion of the partition wall 60 prior to being introduced into the first side air passage 22*a*.

That is, the air current forming structure of this invention, with both the exhaust fan 22 installed on the upper partition panel 12 at a front portion and the partition wall 60 dividing the channel above the panel 12 into front and rear air passages, divides the air current from the air outlet opening 22*d* of the exhaust motor 22 into two air currents as described above. The air current from the air outlet opening 22*d* of the exhaust motor 22 partially flows downward, and partially flows backward to the PCB support bracket 70. This air current flows along the upper and lower surfaces of the PCB support bracket 70, and passes around the rear portion of the partition wall 60 on the upper partition panel 12 prior to being discharged from the air outlet opening 22*d* again by the suction force of the exhaust motor 22.

In an operation of the microwave oven of this invention, the air current, flowing along the partition wall 60, sufficiently cools the PCB seated on the support bracket 70. It is thus possible to maintain the desired function of the PCB and to accomplish the operational reliability of the microwave oven of this invention.

The construction of the machine chamber and air currents within the machine chamber will be described herein below with reference to FIGS. 3 and 4. As shown in FIG. 4, an upper heater 32*a* is externally installed on the top wall 2*b* of the cooking cavity 2, while a lower heater 32*b* is externally installed on the bottom wall 2*a* of the cavity 2. In the microwave oven of this invention, the two heaters 32*a* and 32*b* act as an additional heating means for generating heat used for heating food in the cavity 2.

The upper partition panel 12 is positioned above said top wall 2*b* of the cavity 2 such that the channel defined above the top wall 2*b* is divided into an upper inside air passage 18*a* and an upper outside air passage 17 by the panel 12, with the upper heater 32*a* installed within the upper inside air passage 18*a*.

An upper heater cooling fan 24 is installed on the top wall of the machine chamber 40, and is used for cooling the upper heater 32*a*. The pressurized air current formed by the above cooling fan 24 is sucked from the machine chamber 40 to flow in the upper inside air passage 18*a* formed between the upper partition panel 12 and the top wall 2*b* of the cavity 2. Therefore, the upper heater 32*a* installed within the upper inside air passage 18*a* is properly cooled by the cooling air current flowing in the air passage 18*a*.

The upper inside air passage 18*a*, formed between the upper partition panel 12 and the top wall 2*b* of the cavity 2, extends to the left-hand sidewall of the cavity 2 as shown in the drawings so as to communicate with a second side air passage 18*b* formed outside the left-hand sidewall of the cavity 2. A side partition panel 12*a* extends downward from the left-hand end of the upper partition panel 12 while being spaced apart from the left-hand sidewall 2*c* of the cavity 2 by a predetermined parallel gap, with the second side air passage 18*b* formed between the left-hand sidewall 2*c* of the cavity 2 and the side partition panel 12*a*. In the present invention, it should be understood that the upper and side partition panels 12 and 12*a* may be integrally formed as a single structure.

The pressurized air current formed by the upper heater cooling fan 24 primarily passes through the upper inside air passage 18*a* while cooling the upper heater 32*a*, and passes down along the second side air passage 18*b*. In such a case, the second side air passage 18*b* extends downward to a position below the bottom wall 2*a* of the cavity 2, and so it is possible to discharge the air current from the second side air passage 18*b* to the atmosphere through the exhaust grille 20.

The air current from the upper heater 32*a* flows down through the second side air passage 18*b*, and flows through a horizontally positioned lower air passage 18*c* prior to being discharged from the passage 18*c* through the right-hand open end of said passage 18*c*. A lower partition panel 50 extends horizontally from the lower end of the side partition panel 12*a* in a rightward direction at a position under the bottom wall 2*a* of the cavity 2, thus dividing the channel defined under the bottom wall 2*a* of the cavity 2 into two passages: the lower inside air passage 18*c* and a lower outside passage 22*b*. The second side air passage 18*b* communicates with the lower inside air passage 18*c*, and so the air current from the lower inside air passage 18*c* is discharged from the external casing to the atmosphere through the exhaust grille 20.

In addition, a lower heater cooling fan 28 is installed at a predetermined position under the machine chamber 40, and is used for cooling the lower heater 32*b*. The above lower heater cooling fan 28 sucks an air current from the machine chamber 40 and cools the lower heater 32*b* installed on the bottom wall 2*a* of the cavity 2.

The pressurized air current formed by the lower heater cooling fan 28 passes through a lower heater cooling air passage 28*a* formed under the bottom wall 2*a* of the cavity 2. Since the above lower heater 32*b* is installed on the bottom wall 2*a* of the cavity 2 at a predetermined position within the lower heater cooling air passage 28*a*, the air current flowing in said air passage 28*a* properly cools the lower heater 32*b*.

As shown in FIG. 2, the lower heater cooling air passage 28*a* is designed to partially communicate with the lower inside air passage 18*c*. That is, the bottom wall of the lower heater cooling air passage 28*a* is connected to the lower partition panel 50, and so the air current from the lower heater cooling air passage 28*a* flows through the lower inside air passage 18*c* prior to being discharged from the external casing to the atmosphere through the exhaust grille 20.

Figure 3:
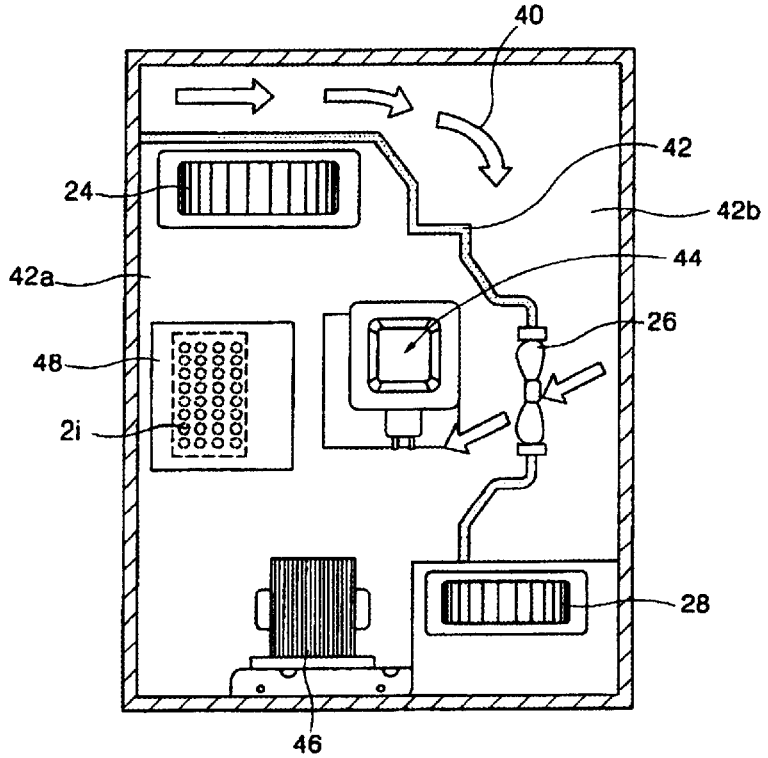
FIG. 3 is a side view, showing the construction of a machine chamber included in the built-in microwave oven of FIG. 1.

FIGS. 3 and 4 also show another air current within the external casing of the oven of this invention. As shown in the drawings, a magnetron 44 used for generating high-frequency electromagnetic waves and a high voltage transformer 46 used for supplying a high voltage to the magnetron 44 are installed within the machine chamber 40 at predetermined positions. When the microwave oven of this invention is operated, both the magnetron 44 and the high voltage transformer 46 generate heat, and so it is necessary to cool the magnetron 44 and the high voltage transformer 46. In order to accomplish the above object, a machine chamber cooling fan 26 is installed within the machine chamber 40 at a proper position.

In the preferred embodiment of the invention, the above machine chamber cooling fan 26 is vertically mounted to an internal frame 42 of the machine chamber 40 such that the fan 26 effectively forms a forward cooling air current within the machine chamber 40 to cool the magnetron 44 and the transformer 46.

In the present invention, it should be understood that the above fan 26 may be somewhat inclinedly positioned within the machine chamber 40 at a predetermined angle of inclination to effectively form a cooling air current for both the magnetron 44 and the transformer 46. In the preferred embodiment shown in the drawings, the fan 26 is installed on the internal partition wall 42 within the machine chamber 40. However, it should be understood that the mounting structure for the fan 26 may be changed from the above-mentioned structure without affecting the functioning of this invention.

In addition, it should be understood that the construction of the machine chamber cooling fan 26 may be somewhat freely changed from the above-mentioned construction if the changed construction effectively generates pressurized cooling air current capable of properly cooling the heat generating elements, such as the magnetron 44 and the high voltage transformer 46, set within the machine chamber 40.

As shown in the drawings, the pressurized air current formed by the machine chamber cooling chamber 26 primarily passes by the magnetron 44 and the transformer 46 to cool them, and is secondarily guided into the cooking cavity 2 through an air duct 48. The air current is, thereafter, discharged from the cooking cavity 2, and flows to the exhaust grille 20 so as to be finally discharged from the external casing to the atmosphere through said grille 20. In an embodiment of the present invention, the air passage structure for allowing the air current to be discharged from the cavity 2 and to be finally discharged from the external casing may comprise an exhaust unit having a plurality of ventilation holes formed on the top wall 2*b* of the cavity 2 in the same manner as that of conventional microwave ovens. In the case of a microwave oven having such an exhaust unit with the ventilation holes, the air may be primarily discharged from the cavity 2 through the ventilation holes of the top wall 2*b*, and secondarily pass through the second side air passage 18*b* prior to being finally discharged from the external casing to the atmosphere through the exhaust grille 20.

As described above, three fans are installed within the external casing of the oven of this invention at positions around the machine chamber 40. That is, the microwave oven of this invention has the first cooling fan 24 used for cooling the upper heater 32*a*, the second cooling fan 26 used for cooling the heat generating elements within the machine chamber 40, such as the magnetron 44 and the high voltage transformer 46, and the third cooling fan 28 used for cooling the lower heater 32*b*. The above-mentioned three cooling fans 24, 26 and 28 together generate desired suction force for sucking atmospheric air into the external casing of the oven through the suction grille 10 while pressurizing the air, and, thereafter, guide the inflow air into the machine chamber 40 prior to allowing the air to pass through the cooking cavity 2, the upper inside air passage 18*a* and the lower heater cooling air passage 28*a*.

As shown in FIG. 1, the pressurized inflow air from the suction grille 10 partially flows through the first side air passage 22*a* formed inside the sidewall of the external casing of the oven by the suction force of the exhaust motor 22. The remaining inflow air flows into the machine chamber 40 through the air inlet opening 6. The air current, introduced into the machine chamber 40 through the opening 6, is formed by the suction force generated by the three cooling fans 24, 26 and 28 as described above.

The operational effect of the microwave oven of this invention and air currents within the oven during a variety of operational modes performed using the upper and lower heaters and/or the magnetron will be described in detail as follows:

When the oven is turned on, a high voltage is applied from the high voltage transformer 46 to the magnetron 44, thus activating the magnetron 44. The magnetron 44 thus generates high-frequency electromagnetic waves, and radiates the waves into the cavity 2. In such a case, the upper and lower heaters 32*a* and 32*b* may be turned on in accordance with a selected operational mode of the oven, and so the heaters 32*a* and 32*b* generate heat to radiate the heat into the cavity 2.

During an operational mode using the upper and lower heaters 32*a* and 32*b* in addition to the magnetron 44, the two heaters 32*a* and 32*b* and the magnetron 44 generate heat, and so it is necessary to form cooling air currents for cooling such heat generating elements. Therefore, the four suction force generating elements, that is, the exhaust motor 22, the upper and lower heater cooling fans 24 and 28, and the machine chamber cooling fan 26 are activated to form a desired suction force. It is thus possible to suck atmospheric air into the external casing of the oven through the suction grille 10 while pressurizing the air, and to form desired cooling air currents under pressure within said external casing as will be described herein below.

The inflow air from the suction grille 10 is partially guided into the machine chamber 40 through the air inlet opening 6 of the chamber 40, while the remaining inflow air is guided into the first side air passage 22*a* by the suction force of the exhaust motor 22.

The inflow air introduced into the machine chamber 40 flows as follows. That is, the upper heater cooling fan 24 forms a pressurized air current. This air current flows from the chamber 40 into the upper inside air passage 18*a*, and passes through the passage 18*a* while cooling the upper heater 32*a* installed on the top wall 2*b* of the cavity 2. The air current from the upper inside air passage 18*a* flows down through the second side air passage 18*b* formed outside the sidewall 2*c* of the cavity 2. In such a case, the lower end of the second side air passage 18*b* communicates with the inlet end of the lower inside air passage 18*c* externally and horizontally extending along the bottom wall 2*a* of the cavity 2, and so the air current from the second side air passage 18*b* flows horizontally through the lower inside air passage 18*c* to be discharged from the outlet end of said passage 18*c*. The air current is, thereafter, discharged from the external casing to the atmosphere through the exhaust grille 20.

On the other hand, the pressurized air current formed by the machine chamber cooling fan 26 flows within the machine chamber 40 while cooling the heat generating elements, such as the magnetron 44 and the high voltage transformer 46, to desired low temperatures. Thereafter, the air current under pressure is introduced from the chamber 40 into the cavity 2 through the air duct 48 as shown in FIG. 3, and is forcibly discharged from the cavity 2 together with steam and smoke generated from food during the heating and cooking process. That is, the air current under pressure together with steam and smoke is discharged from the cavity 2 through the ventilation holes of the top wall 2*b* of the cavity 2, and flows down along the second side air passage 18*b* together with the air flow from the upper inside air passage 18*a* The downward flowing air current through the passage 18*b* will be finally discharged from the external casing to the atmosphere through the exhaust grille 20 in the same manner as that described above.

In addition, the pressurized air current formed by the exhaust fin 22 is primarily discharged from the air outlet opening 22*d*. The air current from the air outlet opening 22*d* partially flows downward through the first side air passage 22*a*, while the remaining part of the air current flows backward to pass through the air passages defined above and under the PCB support bracket 70, thus cooling the PCB of the support bracket 70. The air currents from the PCB support bracket 70 flow down along the first side air passage 22*a*. In such a case, the partition wall 60 guides a part of the air current from the air outlet opening 22*d* to allow the air current to flow along the PCB support bracket 70 as described above. The air currents, flowing down along the first side air passage 22*a*, reaches the bottom wall 2*a* of the cavity 2, thus being finally discharged from the external casing to the atmosphere through the exhaust grille 20.

On the other hand, the lower heater cooling fan 28, externally provided on the bottom wall of the machine chamber 40, sucks the air from the machine chamber 40 to form a pressurized cooling air current flowing through the lower heater cooling air passage 28*a*. This cooling air current cools the lower heater 32*b* while passing through the passage 28*a*.

In the microwave oven of this invention, the object of the lower heater cooling air passage 28*a* is to guide a cooling air current for the lower heater 32*b*.

In the preferred embodiment of FIG. 2, the lower heater cooling air passage 28*a* is joined to the second side air passage 18*b* guiding the air current from the upper heater 32*a*. That is, the air currents, flowing in the lower heater cooling air passage 28*a* and the second side air passage 18*b*, are mixed together at a position around the left-hand end portion of the bottom wall 2*a* of the cavity 2 in the drawings, thus forming a mixed air current. This mixed air current flows through the lower inside air passage 18*c* to be finally discharged from the external casing to the atmosphere through the exhaust grille 20.

INDUSTRIAL APPLICABILITY

As described above, the present invention provides a built-in microwave oven, designed to be installed in kitchen furniture at a predetermined position as an integral part of the kitchen furniture and to allow cooling air for heat generating elements to be sucked into and discharged from the external casing through the front wall of the oven. It is thus possible to provide effective built-in microwave ovens, which effectively form cooling air currents within the external casing for cooling a variety of heat generating elements within said external casing.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A built-in microwave oven, comprising an external casing, and a cooking cavity set within said external casing and used for heating food seated therein, further comprising:

a suction grille provided on a front wall of said external casing at a position corresponding to an upper portion above said cooking cavity for sucking air into the external casing;

an exhaust grille provided on said front wall of the external casing for discharging air from the external casing to the atmosphere;

an exhaust fan provided on a top wall of said cooking cavity at a front portion around the suction grille, and used for generating a suction force for sucking air into the external casing through the suction grille;

a partition wall longitudinally installed at a position in back of said exhaust fan; and an internal air passage guiding the air from the suction grille to the exhaust grille, whereby the air sucked into the external casing by the suction force of the exhaust fan partially flows from a rear passage defined in back of the partition wall to a front passage defined in front of the partition wall prior to flowing through the internal air passage to the exhaust grille.

2. The built-in microwave oven according to claim 1, wherein a PCB support bracket, seating a printed circuit board (PCB) thereon, is installed within said rear passage defined in back of the partition wall.

3. The built-in microwave oven according to claim 2, wherein said PCB support bracket is spaced apart from the top wall of said cooking cavity at a predetermined gap, thus allowing the air to flow along upper and lower passages divided above and under the PCB support bracket.

4. The built-in microwave oven according to claim 1, wherein said internal air passage comprises a side air passage defined between a sidewall of said cavity and a sidewall of said external casing.

5. The built-in microwave oven according to claim 1, wherein a channel between the external casing and the cavity is divided by a partition panel unit into an inside passage and an outside passage, with both the exhaust fan and the partition wall installed on an upper surface of said partition panel unit.

6. The built-in microwave oven according to claim 5, wherein said partition panel unit comprises:

an upper partition panel dividing a channel between the top wall of said cavity and the top wall of said external casing;

a side partition panel dividing a channel between the sidewall of said cavity and the sidewall of said external casing; and a lower partition panel dividing a channel between the bottom wall of said cavity and the bottom wall of said external casing, whereby said upper, side and lower partition panels continuously extend from each other, thus each dividing the channel between the cooking cavity and the external casing into one inside passage and one outside passage.

7. The built-in microwave oven according to claim 5, further comprising a heater externally installed on each of the top and bottom walls of said cooking cavity at a position within the inside passage, and used for generating heat and radiating the heat into said cooking cavity.

8. The built-in microwave oven according to claim 5, further comprising air current forming means for guiding air so as to cool the heater installed on each of the top and bottom walls of said cooking cavity at a position within the inside passage.

9. The built-in microwave oven according to claim 5, wherein the air flowing in the inside passage and the air flowing in the outside passage are mixed together at a position before the exhaust grille.

10. A built-in microwave oven, comprising an external casing, and a cooking cavity set within said external casing and used for heating food seated therein, firer comprising:

a suction grille provided on a front wall of said external casing at a position corresponding to an upper portion above said cooking cavity for sucking air into the external casing;

an exhaust grille provided on said front wall of the external casing for discharging air from the external casing to the atmosphere;

a heater externally installed on said cooking cavity, and used for generating heat and radiating the heat into said cooking cavity;

a first inside air passage guiding air from said suction grille to the exhaust grille while allowing the air to pass by the heater;

an exhaust fan provided on a top wall of said cooking cavity at a front portion around the suction grille, and used for generating a suction force for sucking air into the external casing through the suction grille;

a partition wall longitudinally installed at a position in back of said exhaust fan; and a second inside air passage guiding air from the suction grille to the exhaust grille, whereby the air sucked into the external casing by the suction force of the exhaust fan partially flows around the partition wall prior to flowing through the second inside air passage to reach the exhaust grille, and the air flowing in the first inside passage and the air flowing in the second inside passage are mixed together at a position before the exhaust grille.

* * * * *